US007560876B2

(12) United States Patent
Soo

(10) Patent No.: US 7,560,876 B2
(45) Date of Patent: Jul. 14, 2009

(54) LIGHT DEVICE AND CONTROL METHOD THEREOF

(75) Inventor: Park Seong Soo, Gwangsan-gu (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 11/848,902

(22) Filed: Aug. 31, 2007

(65) Prior Publication Data

US 2008/0054818 A1 Mar. 6, 2008

(30) Foreign Application Priority Data

Aug. 31, 2006 (KR) ..... 10-2006-0083239

(51) Int. Cl.
*G05F 1/00* (2006.01)

(52) U.S. Cl. ..... 315/291; 315/312; 315/185 R

(58) Field of Classification Search ..... 315/149, 315/150, 152, 185 R, 291, 312
See application file for complete search history.

(56) References Cited

U.S. PATENT DOCUMENTS

2007/0052375 A1* 3/2007 Lin et al. ..... 315/312

FOREIGN PATENT DOCUMENTS

KR 10-2006-0056243 5/2006

* cited by examiner

*Primary Examiner*—Douglas W Owens
*Assistant Examiner*—Jianzi Chen
(74) *Attorney, Agent, or Firm*—Saliwanchik, Lloyd & Saliwanchik

(57) ABSTRACT

Provided is a light device. The light device according to one embodiment comprises a backlight unit, a plurality of color sensors, a backlight unit driver, and a backlight unit controller. The backlight unit comprises a light emitting diode device to provide light. The plurality of color sensors senses a wavelength and an amount of light from the light emitting diode device to transmit sensed values as feedback. The backlight unit driver supplies driving power having a duty ratio of pulse width modulation to the light emitting diode. The backlight unit controller receives the sensed values to calculate an average value, a maximum value, a median value, and a minimum value, and then controls the duty ratio using the average value, the maximum value, the median value, and the minimum value.

16 Claims, 4 Drawing Sheets

LIGHT DEVICE AND CONTROL METHOD THEREOF

CROSS-REFERENCE TO RELATED APPLICATION

The present application claims the benefit under 35 U.S.C. §119 of Korean Patent Application No. 10-2006-0083239, filed Aug. 31, 2006, which is hereby incorporated by reference in its entirety.

BACKGROUND

A liquid crystal display (LCD) device uses a backlight unit (BLU) as a light source because it does not emit light.

Examples of a light source that can be used for the BLU include CCFLs (cold cathode fluorescent lamps), EEFLs (external electrode fluorescent lamps), and LEDs (light emitting diodes). They are assembled to a chassis of the backlight unit to illuminate light onto a light guide plate, thereby providing light to an LCD device.

BRIEF SUMMARY

Embodiments of the present invention provide a light device having uniform brightness distribution, and a control method thereof.

Embodiments of the present invention also provide a light device that can compensate for brightness deviation caused by heat, and a control method thereof.

A light device according to an embodiment of the present invention comprises: a backlight unit comprising a light emitting diode device for providing light; a plurality of color sensors for sensing a wavelength and an amount of light from the light emitting diode device to transmit sensed values as feedback; a backlight unit driver for supplying driving power comprising a duty ratio of pulse width modulation to the light emitting diode device; and a backlight unit controller for receiving the sensing values to calculate an average value, a maximum value, a median value, and a minimum value, and controlling the duty ratio using the average value, the maximum value, the median value, and the minimum value.

A method for controlling a light device according to an embodiment of the present invention comprises: sensing, at a plurality of color sensors provided to a backlight unit, a wavelength and an amount of light from a light emitting diode device to transmit sensed values as feedback; calculating an average value, a maximum value, a median value, and a minimum value for respective sensed values; and controlling a duty ratio using the calculated average value, maximum value, median value, and minimum value.

A light device according to another embodiment of the presentation comprises: a backlight unit comprising a light emitting diode device for providing light; a first color sensor and a second color sensor for sensing a wavelength and an amount of light from the light emitting diode device to transmit sensed values as feedback; a backlight unit driver for supplying driving power comprising a duty ratio of pulse width modulation to the light emitting diode device; and a backlight unit controller for receiving sensed values of the first and second color sensors to control the duty ratio.

The details of one or more embodiments are set forth in the accompanying drawings and the description below. Other features will be apparent from the description and drawings, and from the claims.

DETAILED DESCRIPTION

Hereinafter, a light device and a control method thereof will be described in detail with reference to the accompanying drawings.

Figure 1:
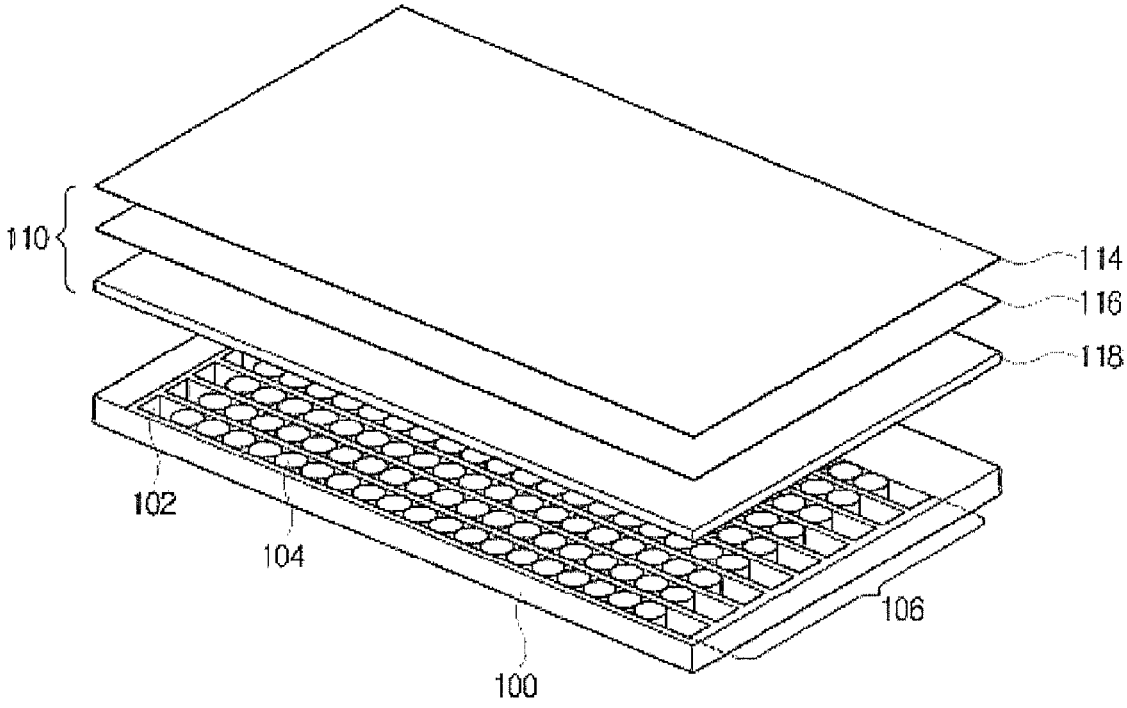
FIG. 1 is an exploded perspective view of a backlight unit.

FIG. 1 is an exploded perspective view of a backlight unit.

The backlight unit (BLU) includes an optical sheet part 110, a light emitting diode (LED) array 106 having a plurality of LED frames 102, and a backlight unit frame 100.

A plurality of light emitting diodes (LEDs) 104 are mounted in the LED frames 102 to provide light. The LED frames 102 are combined to form the LED array 106. The backlight unit frame 100 is an outer frame of the backlight unit.

The optical sheet part 110 can include prism sheets 114 and 116, and a diffusion sheet 118. The diffusion sheet 118 uniformly diffuses light emitted from the LED array 106 onto an entire surface, and the prism sheets 114 and 116 improve light efficiency using refraction of light.

Figure 2:
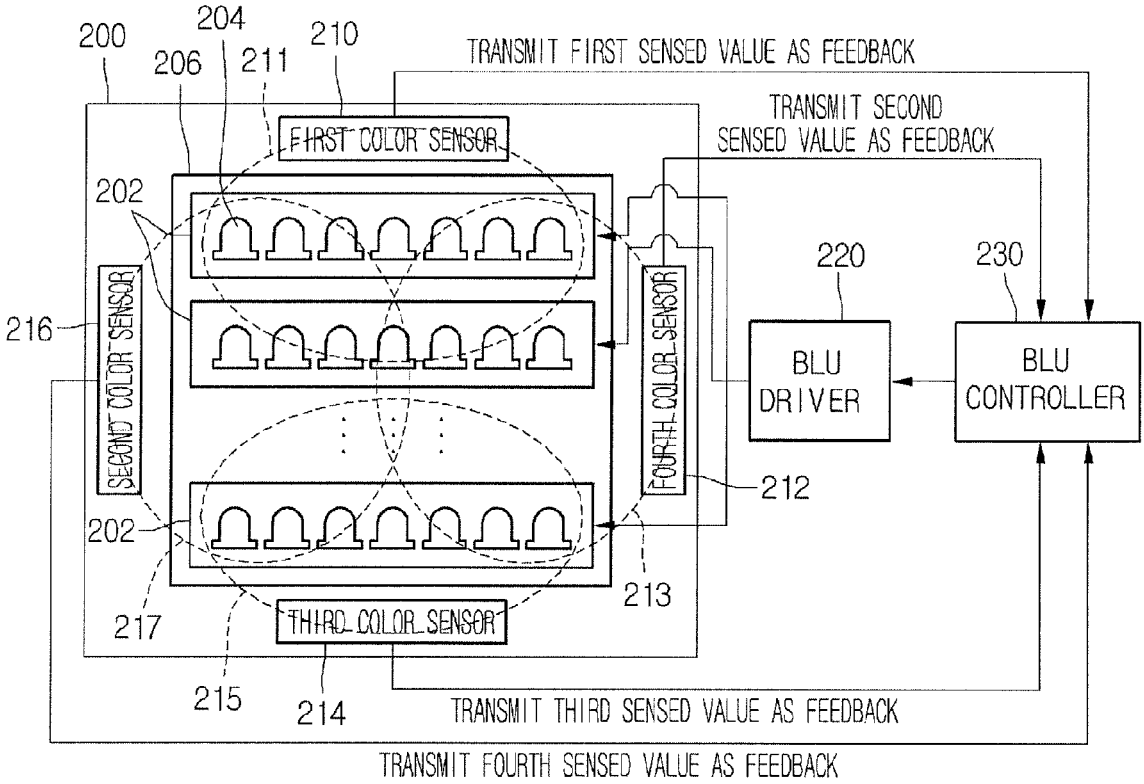
FIG. 2 is a view explaining a light device and a control method thereof according to an embodiment of the present invention.

FIG. 2 is a view explaining a light device and a control method thereof according to a first embodiment.

Referring to FIG. 2, the light device includes a backlight unit 200 having an LED array 206 of a plurality of LED frames 202, a backlight unit (BLU) driver 220, and a backlight unit (BLU) controller 230.

For controlling an amount of light of an LED device 204 within the LED frame 202, the backlight unit controller 230 can apply a pulse width modulation (PWM) control method to control the backlight unit driver 220.

Meanwhile, in the LED device 204 having a semiconductor characteristic, a change in an energy band gap determining the characteristic of spectrum is generated depending on heat emission of the LED device 204 itself.

The change in the band gap generates a phase shift and is deteriorated depending on a driving time and a surrounding temperature. This characteristic of the LED device 204 is regarded as a great limitation in application to an LCD backlight unit.

To solve the above-described limitation, the light device according to an embodiment analyzes the wavelength and an amount of light emitted from the LED device 204 using a color sensor, and provides the analysis values to the backlight unit controller 230 as a feedback, thereby allowing the backlight unit controller 230 to reflect the analysis values in controlling the LED device 204.

The backlight unit 200 includes an LED array 206 having a plurality of LED frames 202 disposed in a series connection, a parallel connection, or a mixed connection of series connection and parallel connection.

The backlight unit 200 outputs light onto a liquid crystal display (LCD) panel using the LED devices 204 inside the LED frame 202.

A plurality of color sensors can be provided along the backlight unit 200. For example, a first color sensor 210, second color sensor 212, third color sensor 214, and fourth color sensor 216 can be provided. The color sensors 210, 212, 214, and 216 sense light output from the LED array 206 for a predetermined period (for example, 1 ms) to provide the sensed values to the backlight unit controller 230 as feedback.

That is, the color sensors 210, 212, 214, and 216 can measure a combination of three light of red, green, and blue light output from the LED array 206 using a device such as a photodiode or a photo transistor to convert the light into an electrical signal. In other words, the color sensors 210, 212, 214, and 216 measured the wavelength and an amount of light output from the LED array 206 to provide the measure values to the backlight unit controller 230 as feedback.

The color sensors 210, 212, 214 and 216 are provided along the backlight unit 200. In FIG. 2, the color sensors 210, 212, 214 and 216 are disposed on each side of the backlight unit 200 one by one, so that a total of four color sensors 210, 212, 214 and 216 are disposed.

Each of the color sensors 210, 212, 214 and 216 can measure light output from the LED array 206 at a variety of positions and transmit the measured values to the backlight unit controller 230. For example, the first color sensor 210 senses light output from a first block portion 211 for a predetermined period. Likewise, the second color sensor 212 senses light output from a second block portion 213 for a predetermined period, the third color sensor 214 senses light output from a third block portion 215 for a predetermined period, and the fourth color sensor 216 senses light output from a fourth block portion 217 for a predetermined period.

The backlight unit driver 220 receives a control value from the backlight unit controller 230 to perform a driving current control of a pulse width modulation (PWM) having a turn on-turn off duty ratio with respect to each LED device 204 in the LED array 206.

In FIG. 2, although the backlight unit driver 220 is illustrated to be connected with LED frames 202 via a single interconnection, the backlight unit driver 220 can supply driving power to each of the LED frames 202.

For high speed operation of the LED device 204, the backlight unit controller 230 performs PWM driving control. The PWM driving control can overcome a turn-on voltage difference between LED devices 204 caused by a whole current supplied for controlling an amount of light from the LED devices 204.

That is, the backlight unit controller 230 can control a reference frequency to generate a waveform having a reference operating frequency, and then output a pulse waveform having a pulse duty ratio of 0-100% in accordance with a reference level set in advance. The backlight unit controller 230 allows the backlight unit driver 220 to perform on/off control of the LED devices 204 of the LED array 206 using a variable pulse signal generated in this manner.

Particularly, in an embodiment, the backlight unit controller 230 performs correction control of the LED array 206 using sensed values measured and supplied as feedback by the color sensors 210, 212, 214 and 216 to control the PWM driving.

For example, the backlight unit controller 230 can calculate an average value of first sensed values received as feedback from the first color sensor 210, a maximum value of second sensed values received as feedback from the second sensor 212, a median value of third sensed values received as feedback from the third sensor 214, and a minimum value of fourth sensed values received as feedback from the fourth sensor 216. Then, the backlight unit controller 230 can reflect differences between these values into the PWM driving control to achieve uniformity of the light source of the backlight unit. A control algorithm of the backlight unit controller 230 is exemplarily illustrated in FIG. 3.

Figure 3:
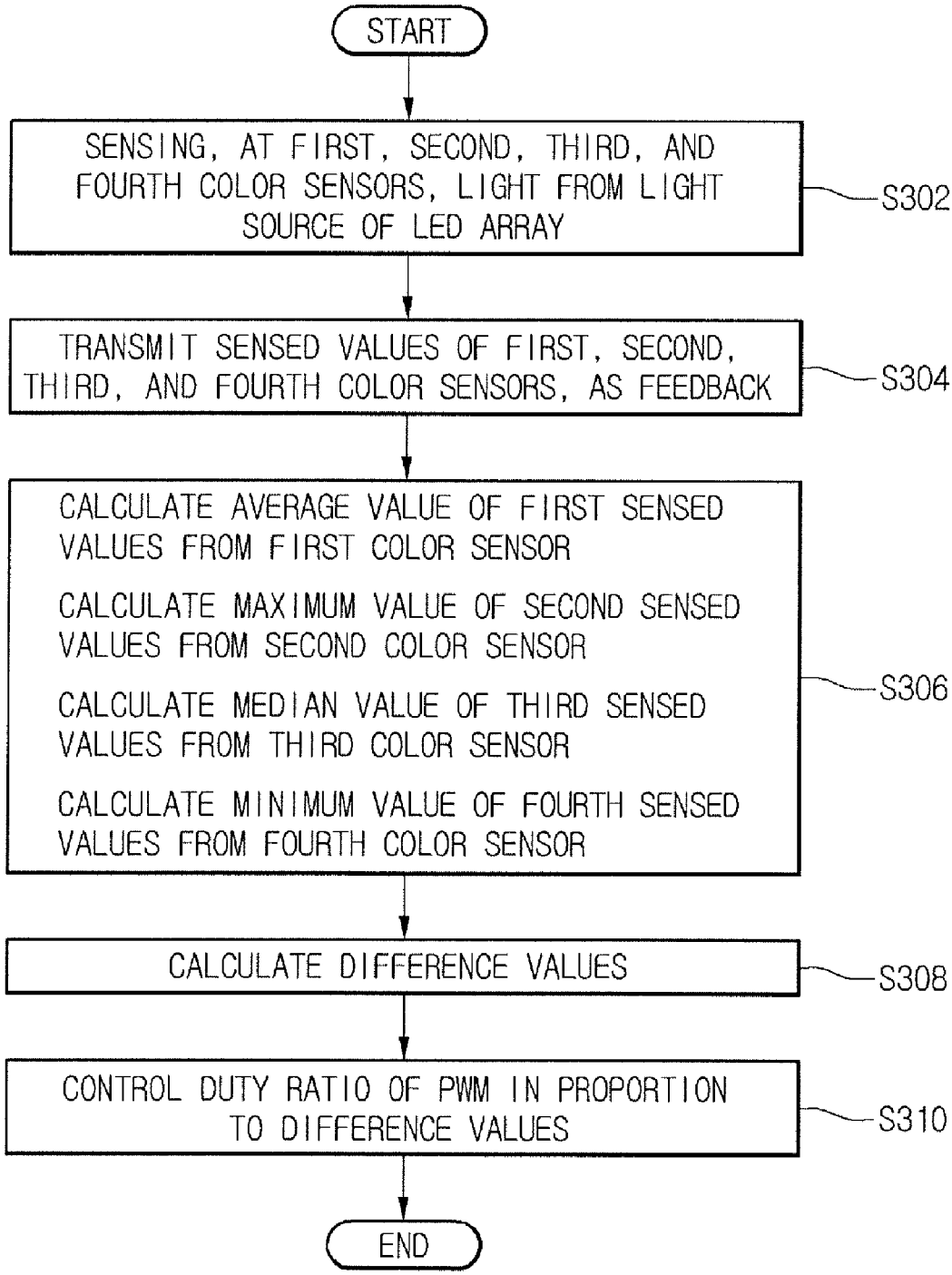
FIG. 3 is a view explaining a method for controlling a light device according to an embodiment of the present invention.

FIG. 3 is a view explaining a method for controlling a light device according to an embodiment.

Referring to FIGS. 2 and 3, the color sensors 210, 212, 214 and 216 sense light output from the LED array 206 at a predetermined period (S302) and transmit sensed values converted into electrical signals from the sensed light to the backlight unit controller 230 as feedback (S304). The period can have various sensing periods (e.g., 1 ms, 2 ms, and 3 ms). The color sensors 210, 212, 214 and 216 can be realized to perform the sensing operation at a short period to increase accuracy of the sensed values of light output from the LED array 206.

The backlight unit controller 230 calculates an average value, a maximum value, a median value, and a minimum value for respective sensed values of the color sensors 210, 212, 214, and 216 using the sensed values transmitted as feedback from the color sensors 210, 212, 214, and 216 (S306).

For example, assuming that 100 first sensed values are transmitted as feedback from the first color sensor 210 having a period of 1 ms during a predetermined time band, an average value of the first sensed values is calculated.

Also, assuming that 100 second sensed values are transmitted as feedback from the second color sensor 212 having a period of 1 ms during the predetermined time band, a greatest sensed value of the second sensed values is determined as a maximum value.

Also, assuming that 100 third sensed values are transmitted as feedback from the third color sensor 214 having a period of 1 ms during the predetermined time band, a sensed value of the third sensed values approximate to a median value is calculated as a median value.

Also, assuming that 100 fourth sensed values are transmitted as feedback from the fourth color sensor 216 having a period of 1 ms during the predetermined time band, a smallest sensed value of the fourth sensed values is determined as a minimum value.

After the average value of the first sensed values, the maximum value of the second sensed values, the median value of the third sensed values, and the minimum value of the fourth sensed value are calculated, difference values between these values are calculated (S308), and then a PWM control controlling a duty ratio in proportion to these difference values is performed (S310).

The PWM control controls a PWM output duty ratio according to a ratio of the respective difference values by applying (+) or (−) change to a current duty ratio.

Table 1 shows an example of PWM control according to the difference values.

| Difference | Size of difference | PWM control |
|---|---|---|
| 'Maximum value of second sensed values − average value of first sensed values' | +10 | Decrease duty ratio by 15% |
| | +20 | Decrease duty ratio by 25% |
| | ... | ... |
| | ... | ... |
| | ... | ... |
| 'Average value of first sensed values − median value of third sensed values' | −10 | Increase duty ratio by 5% |
| | +10 | Decrease duty ratio by 5% |
| | ... | ... |
| | ... | ... |
| | ... | ... |
| ... | ... | ... |

-continued

| Difference | Size of difference | PWM control |
|---|---|---|
| ... | ... | ... |
| ... | ... | ... |
| 'Maximum value of second sensed values – minimum value of fourth sensed values' | +30 | Decrease duty ratio by 5% |
| | +40 | Decrease duty ratio by 10% |
| | ... | ... |
| | ... | ... |
| | ... | ... |

As shown in Table 1, for example, a PWM control can be performed such that a duty ration of the PWM in decreased when a maximum value of second sensed values minus the average value of first sensed values increases.

Meanwhile, duty ratio control can be performed by checking only one of the various difference values, and the duty ratio control can also be performed by considering all of the difference values.

For example, in the case where duty ratios need to be controlled with consideration of all of 'maximum value of second sensed values minus average value of first sensed values', 'average value of first sensed values minus median value of third sensed values', and 'maximum value of second sensed values minus minimum value of fourth sensed values', PWM can be performed using an average value of the calculated duty ratios.

Figure 4:
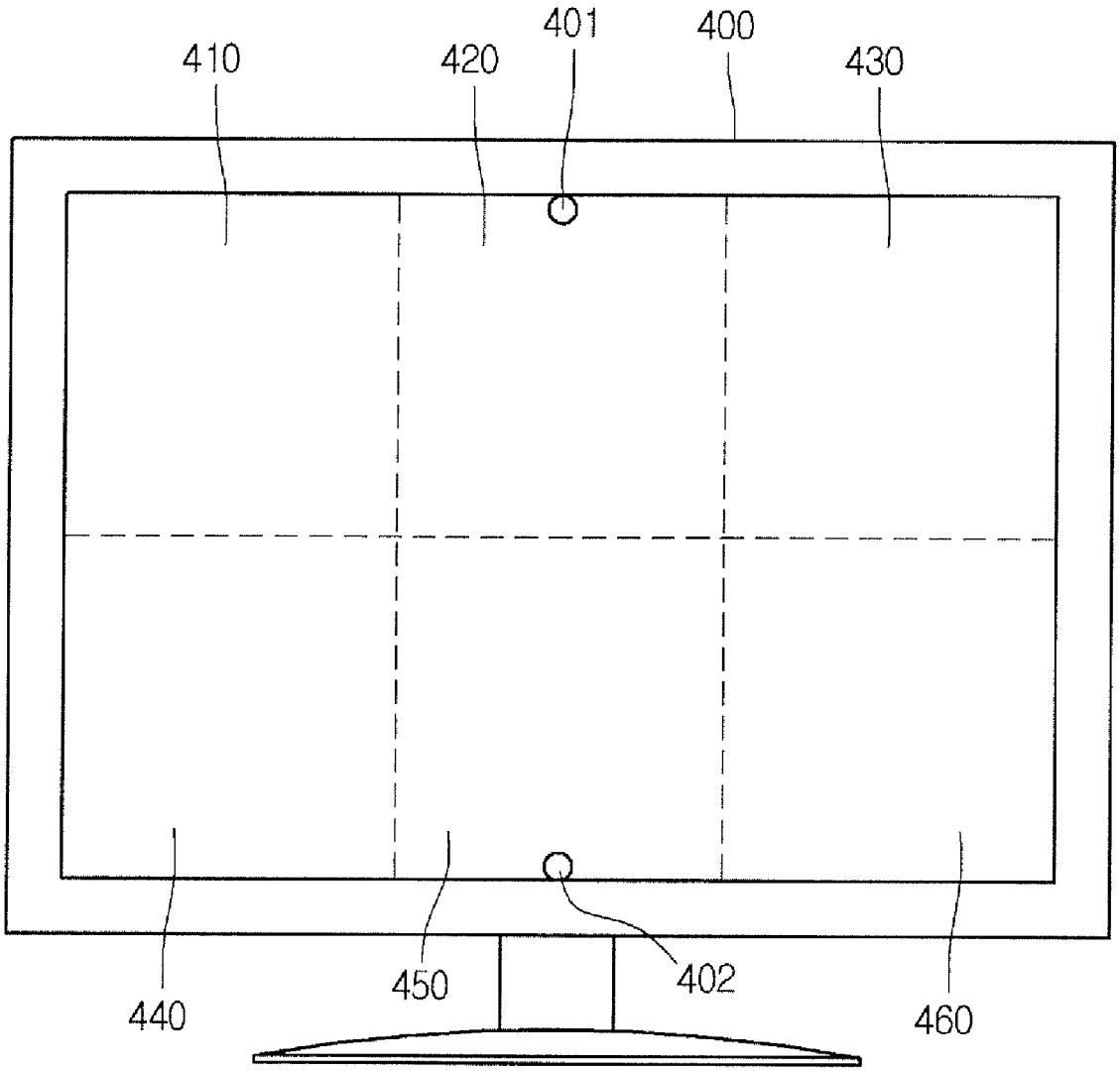
FIG. 4 is a view explaining a light device according to an embodiment of the present invention.

FIG. 4 is a view explaining a light device according to a second embodiment.

FIG. 4 illustrates the positions of a first color sensor 401 and a second color sensor 402 in a display device 400. Though the first and second color sensors 401 and 402 are illustrated on the front side of the display device 400 to clearly mark the positions of the first and second color sensor 401 and 402 in FIG. 4, they can be disposed adjacent to the LED array 206 as shown in FIG. 2 so that they can sense light emitted from an LED device 204.

Though the embodiment of FIG. 2 illustrates that four color sensors are used, the embodiment of FIG. 4 can apply two color sensors to effectively control a light device.

The LED device 204 shows much difference in its operational characteristics depending on temperature. For example, when temperature increases, the brightness of emitted light can decrease.

Since the backlight unit of the display device 400 includes a plurality of LED devices 204 and heat emitted from the LED devices 204 naturally rises, a temperature difference between upper regions 410, 420, and 430, and lower regions 440, 450, and 460 become large in the case where the display device 400 is divided into six regions 410, 420, 430, 440, 450, and 460 as in FIG. 4.

Therefore, the brightness of the LED devices 204 disposed in the upper regions 410, 420, and 430, and the lower regions 440, 450, and 460 differ.

A light device according to second embodiment uses only two color sensors 401 and 402 to apply a simple driving algorithm while reducing the number of the color sensors to minimize costs.

The first color sensor 401 is disposed on the upper regions 410, 420, and 430 where surrounding temperature is high, and the second color sensor 402 is disposed on the lower regions 440, 450, and 460 where surrounding temperature is low.

Also, in the case where the upper regions 410, 420, and 430, and the lower regions 440, 450, and 460 are divided into left portions 410 and 440, central portions 420 and 450, and right portions 430 and 460, the first color sensor 401 and the second color sensor 402 can be disposed on the central portions 420 and 450 to obtain a more accurate sensed value.

Sensed values measured by the first color sensor 401 and the second color sensor 402 are supplied as feedback to the backlight unit controller 230, which calculates an average value of the sensed values to control the LED array 206 through the backlight unit driver 220.

Accordingly, a light device according to an embodiment can include a plurality of color sensors to perform PWM control of a backlight unit using differences between an average value, a maximum value, a median value, and a minimum value of sensed values from the color sensors, thereby performing stable and accurate feedback control. Therefore, color uniformity of an LCD device can be secured.

Also, a light device according to an embodiment can secure color uniformity using only two color sensors by effectively disposing the color sensors.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light device, comprising:

a backlight unit comprising a light emitting diode device;

at least two color sensors capable of sensing wavelength and amount of light from the light emitting diode device and transmitting values representing the sensed wave length and amount of light;

a backlight unit driver capable of supplying driving power comprising a duty ratio based on pulse width modulation to the light emitting diode device; and a backlight unit controller capable of receiving the values from the at least two color sensors and controlling the duty ratio of the backlight unit driver;

wherein the backlight unit controller is further capable of calculating an average value, a maximum value, a median value, and a minimum value of the received values;

wherein the backlight unit controller controls the duty ratio using the average value, the maximum value, the median value, and the minimum value.

2. The light device according to claim 1, wherein the at least two color sensors comprise a first color sensor, a second color sensor, a third color sensor, and a fourth color sensor.

3. The light device according to claim 1, wherein each color sensor of the at least two color sensors senses the wavelength and the amount of light emitted from the light emitting diode device at a period of 1 ms.

4. The light device according to claim 1, wherein the backlight unit controller calculates the average value, the maximum value, the median value, and the minimum value using one hundred sensed values.

5. The light device according to claim 1, wherein the back light unit controller increases and decreases the duty ratio in proportion to difference values between the average value, the maximum value, the median value, and the minimum value.

6. The light device according to claim 2, wherein the first color sensor is disposed at a central region of a first side of the backlight unit, the second color sensor is disposed at a central region of a second side of the backlight unit, the third color sensor is disposed at a central region of a third side of the back light unit, and the fourth color sensor is disposed at a central region of a fourth side of the backlight unit.

7. The light device according to claim 2, wherein the average value is a value obtained by averaging first sensed values output from the first color sensor, the maximum value is determined as a value that is a maximum of second sensed values output from the second sensor, the median value is a median value of third sensed values output from the third color sensor, and the minimum value is determined as a value that is a minimum of fourth sensed values output from the fourth color sensor.

8. The light device according to claim 5, wherein the difference values comprise a value='maximum value−average value', a value='average value−median value', and a value='maximum value−minimum value'.

9. A light device, comprising:

a backlight unit comprising a light emitting diode device;

at least two color sensors capable of sensing wavelength and amount of light from the light emitting diode device and transmitting values representing the sensed wave length and amount of light;

a backlight unit driver capable of supplying driving power comprising a duty ratio based on pulse width modulation to the light emitting diode device; and a backlight unit controller capable of receiving the values from the at least two color sensors and controlling the duty ratio of the backlight unit driver, wherein the at least two color sensors are two color sensors including a first color sensor and a second color sensor, wherein the backlight unit controller controls the duty ratio using an average value of the received values from the first color sensor and the second color sensor.

10. The light device according to claim 9, wherein the first color sensor is disposed on an upper region of the backlight unit.

11. The light device according to claim 9, wherein the second color sensor is disposed on a lower region of the backlight unit.

12. A method for controlling a light device, comprising:

sensing a wavelength and an amount of light from a light emitting diode device using a plurality of color sensors provided on a backlight unit to transmit sensed values as feedback;

calculating an average value, a maximum value, a median value, and a minimum value for respective sensed values; and controlling a duty ratio using the calculated average value, maximum value, median value, and minimum value.

13. The method according to claim 12, wherein controlling the duty ratio comprises proportionally controlling a duty ratio of a pulse width modulation control to turn on and turn off the light emitting diode device depending on difference values of differences between the calculated average value, maximum value, median value, and minimum value.

14. The method according to claim 12, wherein the sensing comprises sensing a wavelength and an amount of light emitted from the light emitting diode device at a period of 1 ms.

15. The method according to claim 12, wherein the color sensors comprise a first color sensor, a second color sensor, a third color sensor, and a fourth color sensor, and the average value is a value obtained by averaging first sensed values output from the first color sensor, the maximum value is determined as a value that is a maximum of second sensed values output from the second sensor, the median value is a median value of third sensed values output from the third color sensor, and the minimum value is determined as a value that is a minimum the fourth sensed values output from a fourth color sensor.

16. The method according to claim 13, wherein the difference values comprise a value='maximum value−average value', a value='average value−median value', and a value='maximum value−minimum value'.

* * * * *